US006053663A

United States Patent [19]

Dikken et al.

[11] Patent Number: 6,053,663

[45] Date of Patent: Apr. 25, 2000

[54] DEVICE FOR CREATING A LOCAL WATER FLOW

[76] Inventors: Jacob Jan Dikken, Piet Heinlaan 5, NL-6881, Eg Velp; Paul Smit, Dorpstraat 137, NL-2731, An Benthuizen, both of Netherlands; Hector Filippus Alexander Van Denham-Susman, 9 Craigston Gardens, Westhill, Skene, Aberdeen AB32 6NL; Kenneth Roderick Stewart, 58 Angusfield Avenue, Aberdeen AB2 6AS, both of United Kingdom; Gerard Louis Marie Van Der Schrieck, Thorbeckestraat 24, NL-2613, Bw Delft; Willem Jan Lucieer, Gustav Mahlerlaan 2, NL-2253, Eb Voorschoten, both of Netherlands

[21] Appl. No.: 08/875,905

[22] PCT Filed: Feb. 7, 1996

[86] PCT No.: PCT/NL96/00059

§ 371 Date: Dec. 8, 1997

§ 102(e) Date: Dec. 8, 1997

[87] PCT Pub. No.: WO96/24727

PCT Pub. Date: Aug. 15, 1996

[30] Foreign Application Priority Data

| | | | |
|---|---|---|---|
| Feb. 7, 1995 | [NL] | Netherlands | 9500228 |
| Feb. 23, 1995 | [GB] | United Kingdom | 9503663 |

[51] Int. Cl.[7] ..... E02F 3/88; F16L 1/20

[52] U.S. Cl. ..... 405/163; 405/73; 405/226; 405/248; 37/323; 37/327; 37/331; 37/343; 416/129

[58] Field of Search ..... 405/163, 226, 405/73, 248; 37/307, 323, 327, 330, 331, 342, 343; 415/199.4; 416/124, 128, 129

[56] References Cited

U.S. PATENT DOCUMENTS

| | | | |
|---|---|---|---|
| 142,577 | 9/1873 | Morse | 37/343 |
| 3,235,232 | 2/1966 | Conover | 415/199.4 X |
| 4,585,401 | 4/1986 | Baldenko et al. | 418/5 |
| 4,932,144 | 6/1990 | Sills | 37/344 |
| 5,171,139 | 12/1992 | Underwood et al. | 418/48 |
| 5,249,378 | 10/1993 | Frame | 37/342 |

FOREIGN PATENT DOCUMENTS

| | | |
|---|---|---|
| 0 053 941 | 6/1982 | European Pat. Off. . |
| 0 289 520 | 11/1988 | European Pat. Off. . |
| 0 328 198 | 8/1989 | European Pat. Off. . |
| 2 377 521 | 8/1978 | France . |
| 382297 | 10/1932 | United Kingdom . |
| 2 240 568 | 8/1991 | United Kingdom . |
| 2 289 912 | 12/1995 | United Kingdom . |
| WO 87/04743 | 8/1987 | WIPO . |
| WO 92/18701 | 10/1992 | WIPO . |
| WO 92/19835 | 11/1992 | WIPO . |
| WO 94/06973 | 3/1994 | WIPO . |
| WO 94/16198 | 7/1994 | WIPO . |
| WO 95/19488 | 7/1995 | WIPO . |

*Primary Examiner*—Eileen Dunn Lillis
*Assistant Examiner*—Tara L. Mayo
*Attorney, Agent, or Firm*—Young & Thompson

[57] ABSTRACT

A device for creating a localized water jet within a body of water allows for the displacement of material from the floor of the body of water. The device includes two powered screws within a jet pipe. The screws are arranged coaxially and their direction of rotation, pitch, and speed of rotation are arranged such that the torque produced by one of the screws tends to counteract the torque produced by the other, allowing for improved control of the device.

31 Claims, 11 Drawing Sheets

120
110
105
115
100
125
11
10
12
22
26
24
20
21
27
34
23
160
165
169
39
37
52
54
185
56
50
18
21
170
57
23
64
186
18
66
150
135
140
145
155
135
210
200
205
195
190
180

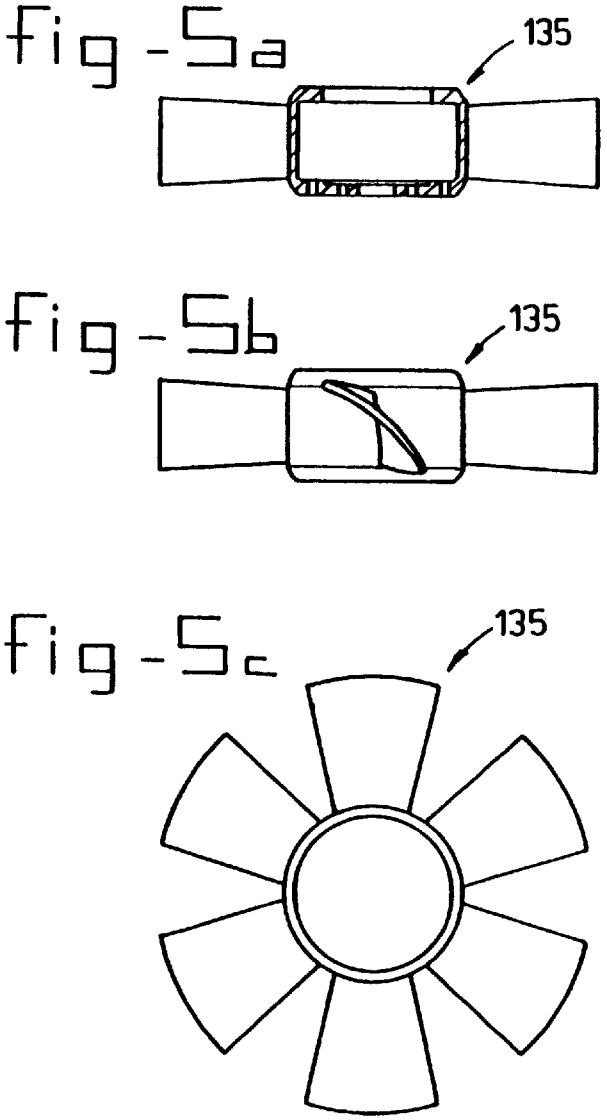
Fig-5a
Fig-5b
Fig-5c
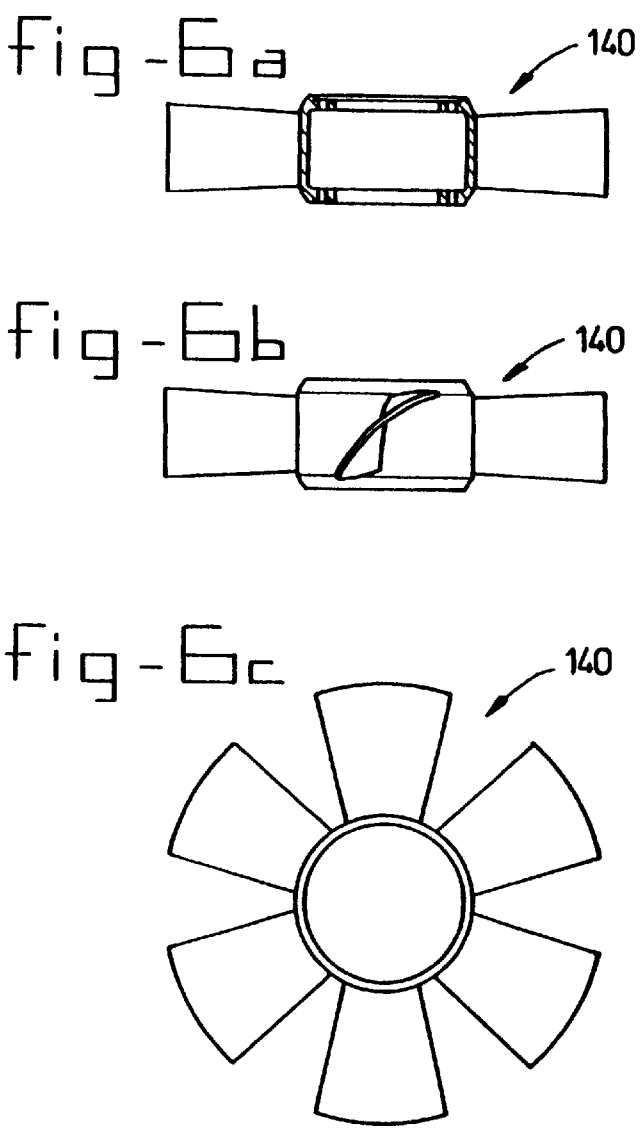
Fig-6a
Fig-6b
Fig-6c 110a
105a
115a
125a
11
120
12a
22a
10a
26a
24a
21a
20a
22a
23a
37a
34a
39a
56a
52a
160a
54a
164a
165a
18a
50a
57a
21a
64a
23a
175a
185a
66a
170a
18a
130a
150a
145a
155a
140a
186a
135a
180a
210a 315
316
314
306
311
312
309
313
304
301
302
307
305
308
303
317
317
341
310

318

DEVICE FOR CREATING A LOCAL WATER FLOW

BACKGROUND OF THE INVENTION

1. Field of the Invention

The invention relates to a device for creating a local water flow or water jet in a body of water, in such a way that bed material from the bed below said body of water can be displaced, which device comprises a jet pipe, a screw disposed rotatably in the jet pipe, and means for supplying a countertorque in the opposite direction to the torque exerted on the device through the rotation of the screw.

2. Description of the Related Art

Such a device is known from EP-A-289520. With this known device it is possible to make a trench in a water bed, in which trench a pipeline, for example, can be laid. For this purpose, the device is moved at some distance above the water bed along the path in which the trench is to be made. The rotating screw in this case supplies the desired water flow.

Since the rotating screw exerts a torque on the device, unless countermeasures were taken, the device would start to rotate uncontrollably about its axis, which is, of course, very undesirable. On account of that, blades are provided in the outlet of the jet pipe, which blades exert a countertorque on the device as a result of the water flow in the jet pipe, in such a way that the device is stabilized as regards such a rotary movement.

A great disadvantage of this device is that the torque generated and the countertorque are the same for a specific outflow rate of the water flow in the jet pipe only within a limited speed of rotation range. On variation of the distance of the device from the bottom, said outflow rate varies, and therefore so does the countertorque.

The torque generated and the countertorque are not easy to keep the same during operation of the device. Rotation of the device therefore has to be prevented by other, additional means.

SUMMARY OF THE INVENTION

The object of the invention is therefore to provide a device of the above mentioned type which does not have these disadvantages. That is achieved through accommodating a second screw in the jet pipe, which second screw is rotatable in the opposite direction to the direction of rotation of the first screw, the screw direction of which being opposite and the combination of pitch with its speed of rotation being such that the torque generated is the same or virtually the same as that of the first screw. The pitch angle is preferably opposite to that of the first screw.

The second screw not only provides the desired countertorque, as a result of which the device remains stable, but also contributes to more efficient functioning of the device as regards the displacement of bed material such as, for example, during the making of a trench in the water bed. This means that no energy is lost during the stabilization of the device.

Through a suitable choice of the second screw it can also be ensured that the required countertorque is always supplied, with the result that no further measures need be taken for synchronizing the operation of the screws.

The first screw and the second screw are preferably accommodated coaxially in the jet pipe; in that case one of the screws can be connected to a hollow driving shaft, and the other screw can be connected to a central driving shaft running coaxially through the hollow driving shaft.

Both driving shafts can project from the jet pipe at the inlet end thereof, and can each be connected to a drive unit. At the top end of the jet pipe suspension means can also be provided, for suspension of the device from a bearing element such as a cable, which is in turn connected to a vessel on the water surface.

The device can also be used for covering pipes, levelling the water bed, jet washing articles or moving quantities of soil etc.

At the outlet side of the jet pipe the device can have various types of nozzles, which can be a round, oval or rectangular shape.

The means for driving the screws may include a drilling motor.

The drilling motor may be a "MOINEAU(™)", hydraulic or suitably adapted electric motor.

Alternatively and advantageously the drilling motor may comprise a stator and a rotor rotatably mounted in the stator, the stator being provided with a rod recess and an exhaust port, the rotor being provided with a rotor channel and at least one channel for conducting motive fluid from the rotor channel to a chamber between the rotor and the stator, the rod recess being provided with a rod which, in use, forms a seal between the stator and the rotor. Such a drilling motor is described in U.S. application Ser. No. 08/191,693 (SUSMAN et al), now abandoned.

Although not essential it is highly desirable that the rotor be provided with a seal for engagement with the stator.

Preferably, the seal is made from a material selected from the group consisting of plastics materials, polyethylethylketone, metal, copper alloys and stainless steel.

Advantageously, the rod is made from a material selected from the group consisting of plastics materials, polyethylethylketone, metal copper alloys and stainless steel.

Preferably, the stator is provided with two rod recesses which are disposed opposite one another and two exhaust ports which are disposed opposite one another, each of the rod recesses being provided with a respective rod, the rotor having two seals which are disposed opposite one another.

The drilling motor may advantageously comprise two drilling motors arranged with their respective rotors connected together each motor comprising a stator and a rotor rotatably mounted in the stator, the stator being provided with a rod recess and an exhaust port, the rotor being provided with a rotor channel and at least one channel for conducting motive fluid from the rotor channel to a chamber between the rotor and the stator, the rod recess being provided with a rod which, in use, forms a seal between the stator and the rotor.

Preferably, the drilling motors are connected in parallel, although they could be connected in series if desired.

Advantageously, the drilling motors are arranged so that, in use, one drilling motor operates out of phase with the other. Thus, in a preferred embodiment each drilling motor has two chambers and the chambers in the first drilling motor are 90° out of phase with the chambers in the second drilling motor. Similarly, in an embodiment in which each drilling motor has four chambers, the chambers in the first drilling motor would preferably be 45° out of phase with the chambers on the second drilling motor. This arrangement helps ensure a smooth power output and inhibits stalling.

The device may provide means for steering the device, in use.

Preferably the steering means comprises at least four apertures on the device, the apertures being equally spaced around a plane through the device, which plane is intended to be substantially horizontal in use, openable gates on each of the four apertures, and means for controlling the opening and closing of each gate, each gate preferably providing a portion which portion extends inwardly when the gate is open (so as to direct—or scoop—water through the respective aperture) the portion further closing the aperture when the gate is closed.

Preferably the control means comprises an electric or hydraulic actuator for each gate, each actuator being controlled by means of an umbilical extending above surface.

Alternatively, the steering means may comprise one or more openable flaps located on the outlet.

Each screw may include a plurality of blades, the blades of one screw being offset by 180° with respect to the blades of the other screw of the pair.

The screws may be in the form of propellers. For example, the screws may be in the form of propellers provided with water jets on the tips thereof as disclosed in GB 2 240 568.

BRIEF DESCRIPTION OF THE DRAWINGS

The invention will be explained in greater detail below with reference to a number of exemplary embodiments shown in the figures.

FIGS. 5A–5C shows a series of views of a first propeller for use in the apparatus of FIG. 4.

FIGS. 6A–6C shows a series of views of a second propeller for use in the apparatus of FIG. 4.

DESCRIPTION OF THE PREFERRED EMBODIMENTS

Some embodiments of an underwater excavation apparatus according to the present invention are disclosed herein. Two embodiments comprise a drilling motor. In order to facilitate understanding of the embodiments of the underwater excavation apparatus disclosed, a detailed description will firstly be given of the drilling motor.

Figure 1:
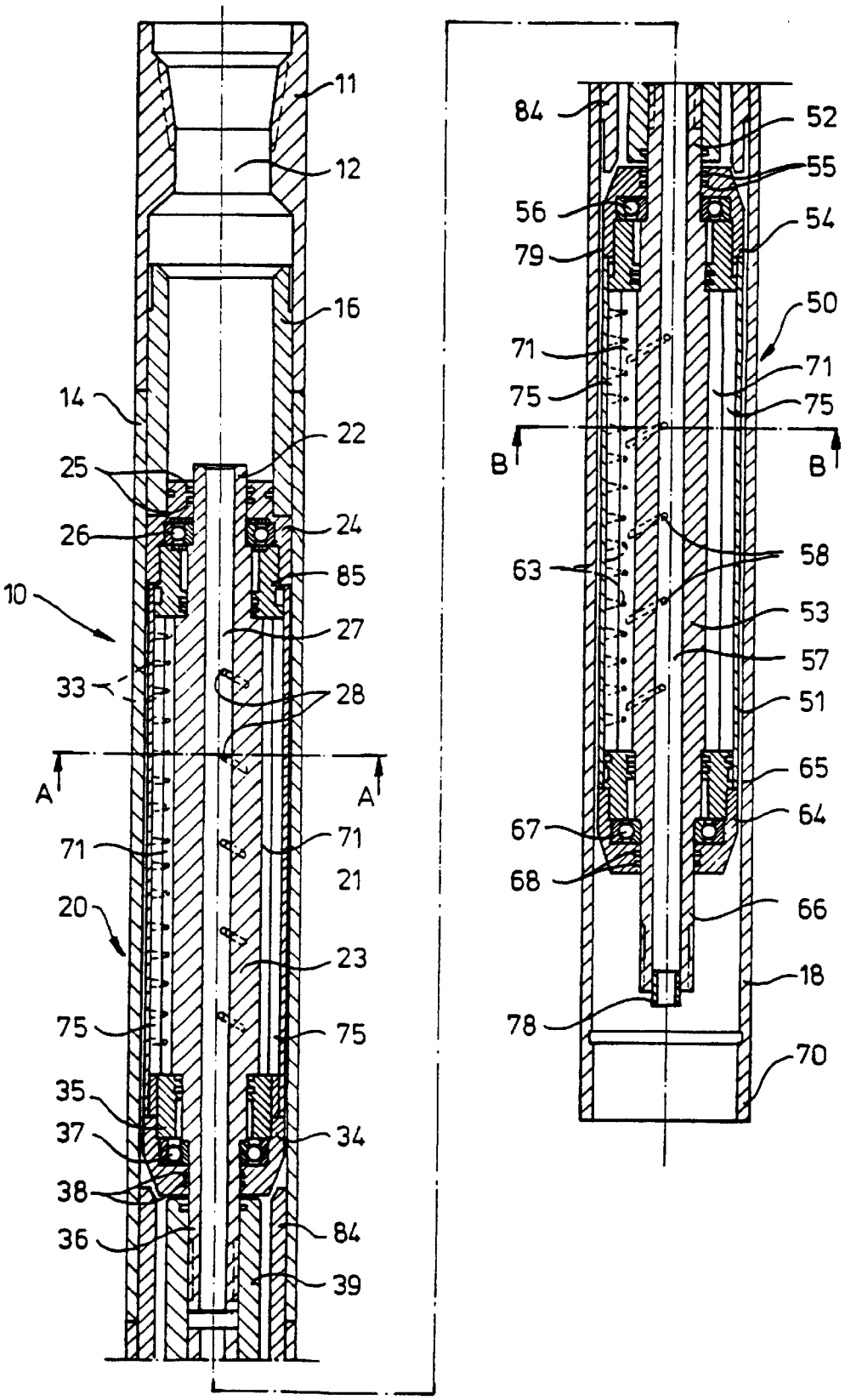
FIG. 1 shows a longitudinal cross-sectional view of a drilling motor for use in an embodiment of the present invention.

Referring to FIG. 1 there is shown the drilling motor generally designated 10. The drilling motor 10 comprises a first motor 20 and a second motor 50.

The first motor 20 comprises a stator 21 and a rotor 23. A top portion 22 of the rotor 23 extends through an upper bearing assembly 24 which comprises a thrust bearing 26 and seals 25.

Motive fluid, e.g. water, drilling mud or gas under pressure, flows down through a central sub channel 12 into a central rotor channel 27, and then out through rotor flow channels 28 into action chambers 31 and 32.

Following a motor power stroke, the motive fluid flows through exhaust ports 33 in stator 21, and then downwardly through an annular channel circumjacent the stator 21 and flow channels 35 in a lower bearing assembly 34. A portion 36 of the rotor 23 extends through the lower bearing assembly 34 which comprises a thrust bearing 37 and seals 38.

The ends of the stator 21 are castellated and the castellations engage in recesses in the respective upper bearing assembly 24 and lower bearing assembly 34 respectively to inhibit rotation of the stator 21. The upper bearing assembly 24 and lower bearing assembly 34 are a tight fit in an outer tubular member 14 and are held against rotation by compression between threaded sleeves 16 and 84.

A splined union 39 joins a splined end of the rotor 23 to a splined end of a rotor 53 of the second motor 50. The second motor 50 has a stator 51.

A top portion 52 of the rotor 53 extends through an upper bearing assembly 54. Seals 55 are disposed between the upper bearing assembly 54 and the exterior of the top portion 52 of the rotor 53. The rotor 53 moves on thrust bearings 56 with respect to the upper bearing assembly 54.

Motive fluid flows into a central rotor channel 57 from the central rotor channel 27 and then out through rotor flow channels 58 into action chambers 61 and 62. Following a motor power stroke, the motive fluid flows through exhaust ports 63 in stator 51, and then downwardly through an annular channel circumjacent the stator 51 and flow channels 65 in a lower bearing assembly 64. A portion 66 of the rotor 53 extends through a lower bearing assembly 64. The rotor 53 moves on thrust bearings 67 with respect to the lower bearing assembly 64 and seals 68 seal the rotor-bearing assembly interface. Also motive fluid which flowed through the flow channels 35 in the lower bearing assembly 34, flows downwardly through channels 79 in the upper bearing assembly 54, past stator 51 and through flow channels 65 in the lower bearing assembly 64.

The upper bearing assembly 54 and lower bearing assembly 64 are a tight fit in an outer tubular member 18 and are held against rotation by compression between threaded sleeve 84 and a lower threaded sleeve (not shown).

Figure 2A:
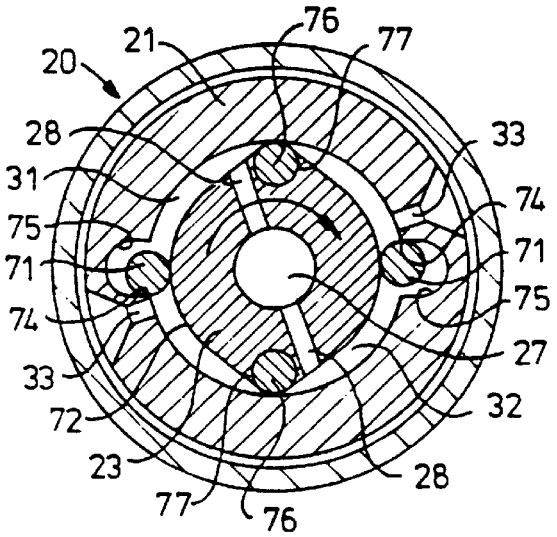
FIGS. 2A–2D shows a series of cross-sectional views along line A—A of FIG. 1 showing the motor in four different positions.
Figure 2B:
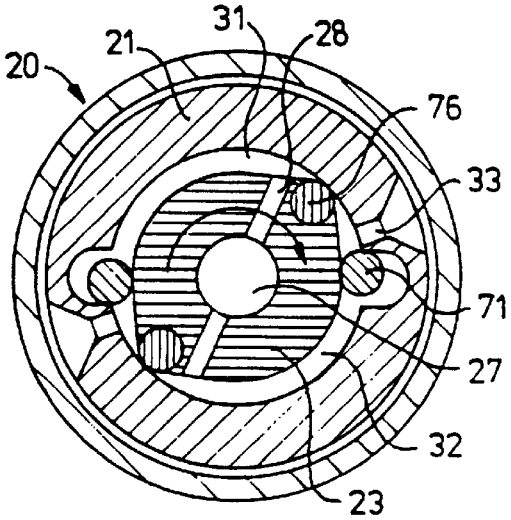
Figure 2C:
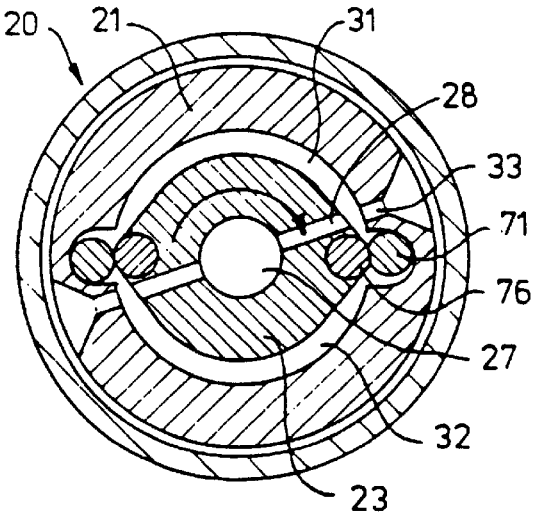

FIGS. 2A–2D and 3A–3D depict a typical cycle for the first and second motors 20 and 50 respectively, and show the status of the two motors with respect to each other at various times in the cycle. For example, FIG. 2C shows an exhaust period for the first motor 20 while FIG. 3C, at that same moment, shows a power period for the second motor 50.

As shown in FIG. 2A, motive fluid flowing through the rotor flow channels 28 enters the action chambers 31 and 32. Due to the geometry of the chambers (as discussed below)

and the resultant forces, the motive fluid moves the rotor in a clockwise direction as seen in FIG. 2B. The action chamber 31 is sealed at one end by a rolling vane rod 71 which abuts an exterior surface 72 of the rotor 23 and a portion 74 of a rod recess 75.

At the other end of the action chamber 31, a seal on a lobe 77 of the rotor 23 sealingly abuts an interior surface of the stator 21.

As shown in FIG. 2B, the rotor 23 has moved to a point near the end of a power period.

As shown in FIG. 2C, motive fluid starts exhausting at this point in the motor cycle through the exhaust ports 33.

Figure 2D:
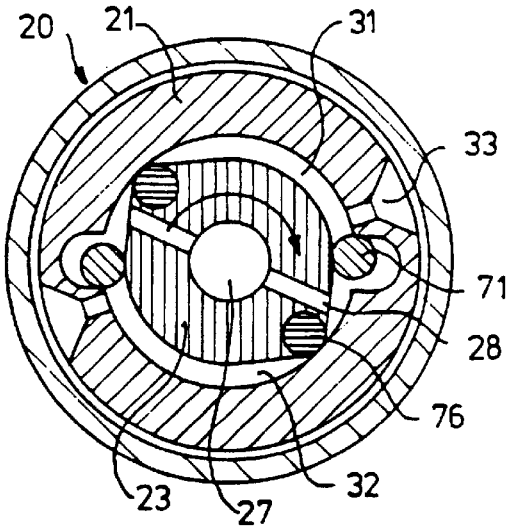
Figure 3A:
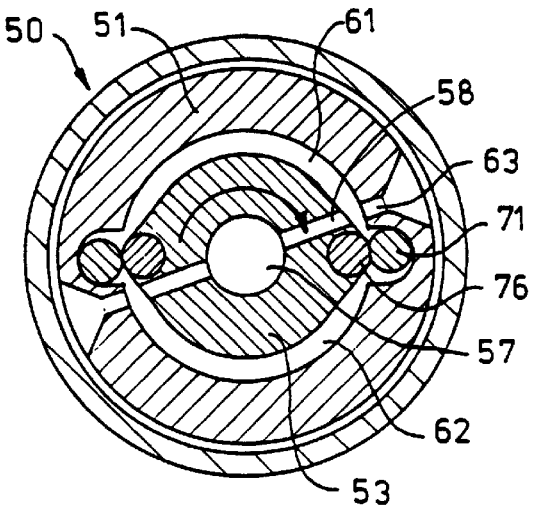
FIGS. 3A–3D shows a series of cross-sectional views along line B—B of FIG. 1 showing the motor in four different positions.
Figure 3B:
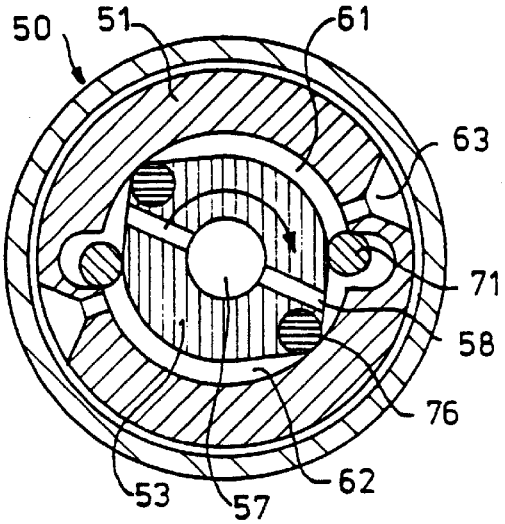
Figure 3C:
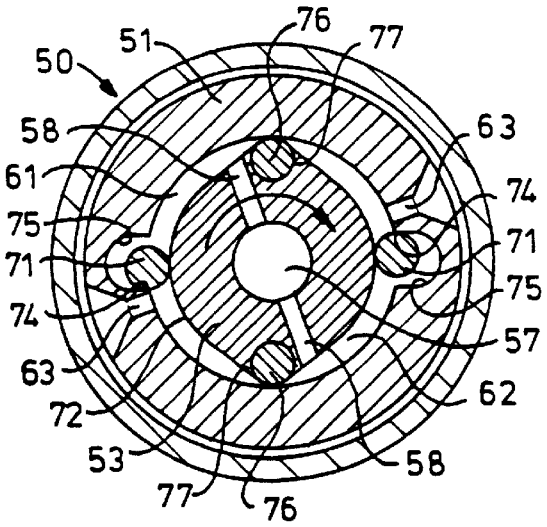
Figure 3D:
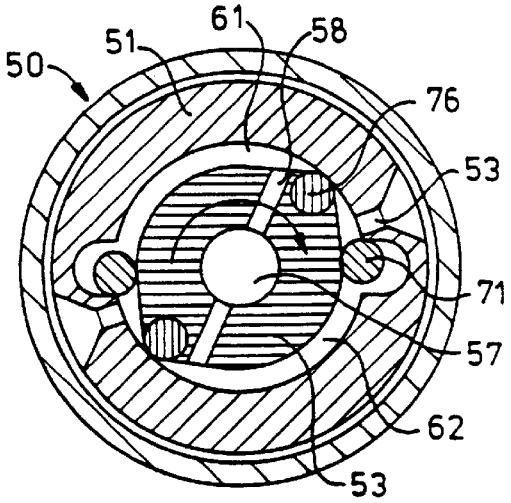

As shown in FIG. 2D, the rolling vane rods 71 and seals 76 have sealed off the action chambers and motive fluids flowing thereinto will rotate the rotor 23 until the seals 76 again move past the exhaust ports 33.

The second motor 50 operates as does the first motor 20; but, as preferred, and as shown in FIGS. 3A–3D, the two motors are out of phase by 90° so that as one motor is exhausting motive fluid the other is providing power.

The seals 76 are, in one embodiment, made of polyethylethylketone (PEEK). The rolling vane rods 71 are also made from PEEK. The rotors (23, 25) and stators (21. 51) are preferably made from corrosion resistant materials such as stainless steel.

When a seal 76 in the first motor 20 rotates past an exhaust port 33, the motive fluid that caused the turning exits and flows downward, then through the channels 79, past the exhaust ports 63 and the flow channels 65.

Figure 4:
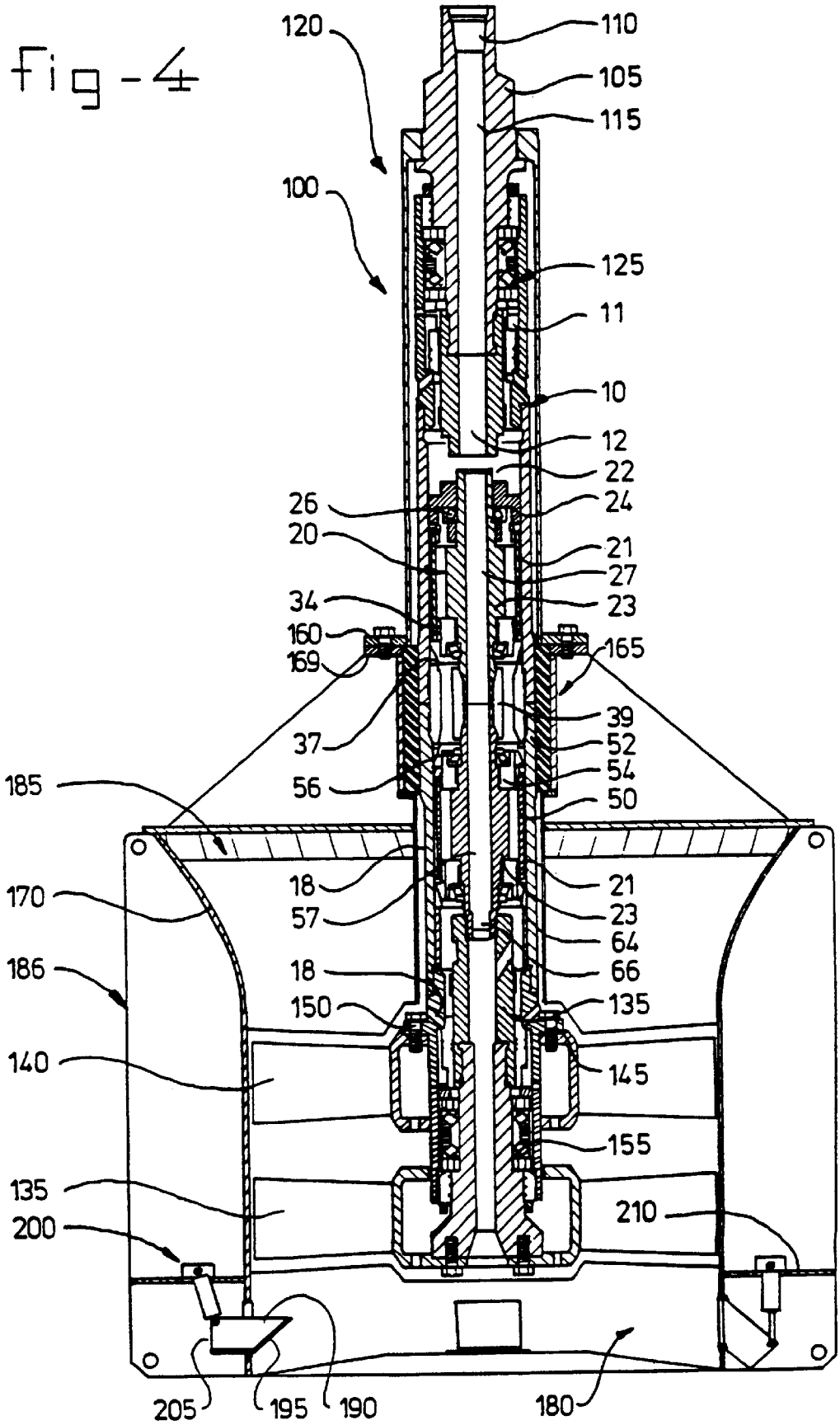
FIG. 4 shows a longitudinal cross-sectional view of a first embodiment of an underwater excavation apparatus according to the present invention.

Referring now to FIG. 4 there is shown a first embodiment of an underwater excavation apparatus according to the present invention, generally designated 100.

The apparatus 100 comprises a connector body 105 having a frustoconical internally threaded portion 110 for connection to drill pipe, coiled tubing or any pipe capable of transporting motive fluid for driving the drilling motor 10 provided within the apparatus 100. The connector body 105 has a through bore 115 which communicates with the central sub channel 12 of motor 20.

Rigidly connected to the connector body 105 is an outer tube 120, such that a portion of the connector body 105 is located with the outer tube 120. Around an outer surface of the portion of the connector body 105 there is rigidly connected a first part of a swivel 125. The swivel 125 comprises first and second parts rotatable with respect to one another. The second part of the swivel 125 is rigidly connected to an upper part 11 of the motor 10 which part is rigidly engaged with the stator 21. The swivel 125 is in this embodiment a known "stuffing box" including combined radial and thrust bearings.

It is, therefore, apparent that the rotors 23, 53 are rotatable with respect to the stators 21. 51 and with respect to the outer tube 120, while the stators 21, 51 are themselves rotatable with respect to the outer tube 120.

The portion 66 of the rotor 53 is rigidly connected to one end of a drive shaft 130 by means of a female spine coupling provided in the drive shaft 130. At the other end of the drive shaft 130 there is provided a first impeller in the form of a first propeller 135.

The stator 51 is rigidly engaged with a second impeller in the form of a second propeller 140 by means of bolts 145 connecting the second propeller 140 to a flanged portion 150 on the end of the outer tubular member 18 of the motor 50.

The first and second propellers 135. 140 are connected between one another by a combined thrust and radial bearing 155.

It is, therefore, apparent that the first propeller 135 rotates with the rotors 23, 53, while the second propeller 140 rotates with the stators 21, 51.

At the end of the outer tube 120 there is provided a flanged portion 160. Below the flanged portion 160 there is provided a marine bearing 165. Connected to the flanged portion 160 by means of bolts 169 is a hollow body 170. The hollow body 170 carries at an inlet thereto four inlet guide vanes 175. At an outlet to the body 170 there are provided a plurality of outlet guide vanes 180. The guide vanes 175, 180 are provided so as to produce a predefined flow of water through the hollow body 170, as is known in the art.

Within the inlet of the hollow body 170 there is provided a safety grid 185. Further equidistantly spaced circumferentially around the hollow body 170 are provided a plurality of (in this embodiment 8) longitudinal strengthening strips 186.

Circumferentially around the outlet of the hollow body 170 there is provided steering means in the form of four apertures 190 equally spaced on the hollow body 170 in a plane through the apparatus 100, which plane is intended to be substantially horizontal in use. Each aperture 190 carries a gate 195. Each gate 195 provides a portion which portion extends inwardly when the gate 195 is open (so as to direct—or scoop—water through the respective aperture 190), the portion further closing the aperture 190 when the gate 195 is closed. Each gate 195 is openable and closable by control means in the form of electric or hydraulic actuators 200 connected to the gate 195 by connecting members 205 and carried by a flange 210 provided around the hollow body 170. The actuators 200 are controlled by means of an umbilical (not shown) extending above surface.

Referring now to FIGS. 5A–5C and 6A–6C, there is shown detailed drawings of the first and second propellers 135, 140. As can be seen each propeller 135, 140 carries six blades. The propellers 135, 140 are substantially identical except that their blades are offset with respect to one another by 180° so that the propellers 135, 140 rotate in contrary rotating directions.

Figure 7:
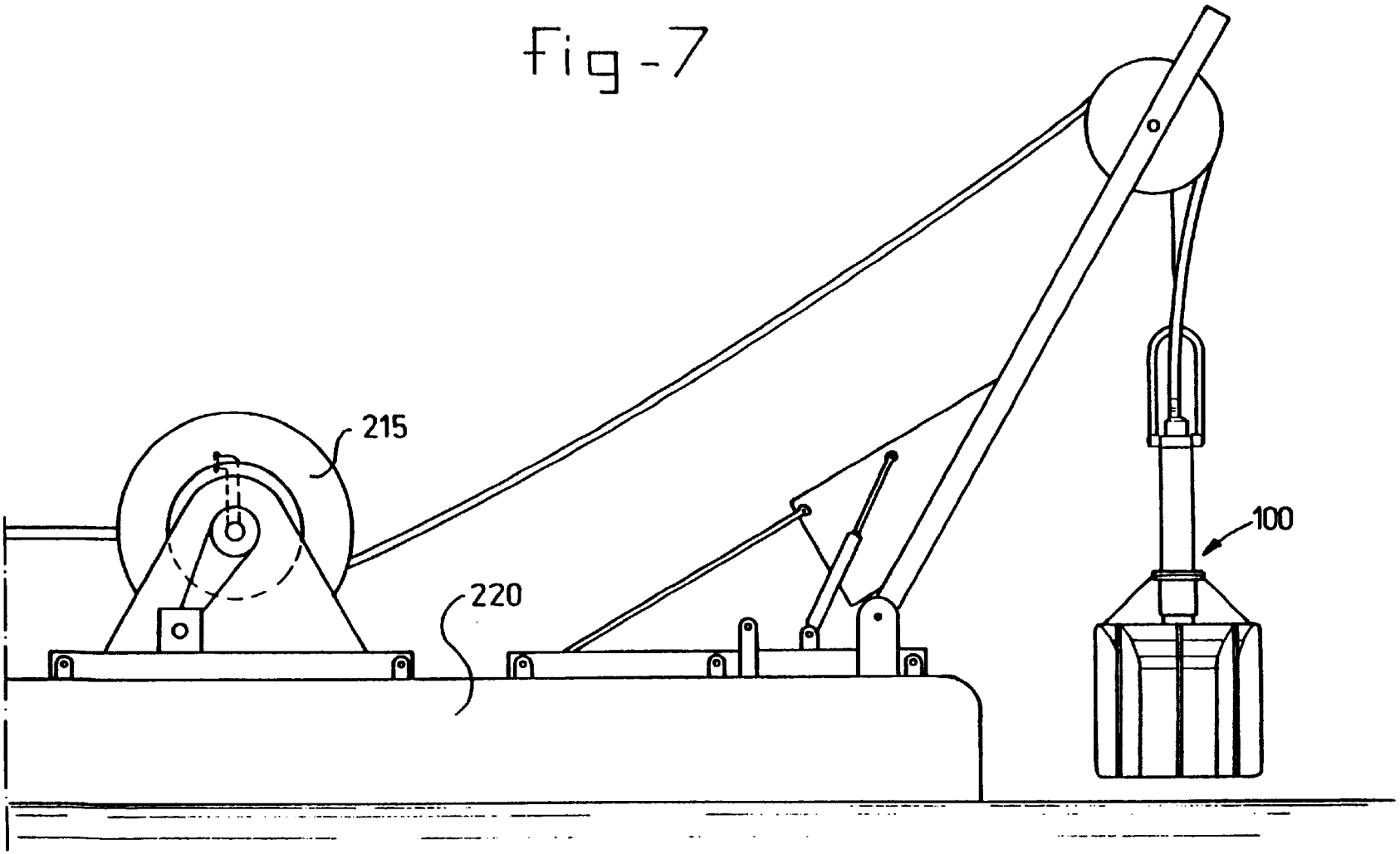
FIG. 7 shows a schematic side view of the apparatus for FIG. 4 connected to a hose reel provided, for example, at the stern of a ship.

Referring to FIG. 7 there is shown the apparatus 100, to be lowered into the sea, connected to a hose reel 215 provided, for example, at the stern of a ship 220.

In use, the apparatus 100 is lowered to the desired position, for example, just above the seabed as is known in the art. The position of the apparatus 100 may be controlled by the positioning means by suitable controlled opening/closing of the gates 195 and operation of the propellers 135, 140.

Once in the desired position the apparatus 10 may be operated by pumping motive fluid into the drilling motor 10. The rotors 23, 53 consequently begin to rotate so driving the first propeller 135 in one direction, Further, the second propeller 140 also begins to rotate by taking up reactive torque of the first propeller 135. The propellers 135, 140, therefore, rotate at the same speed in opposite directions.

Figure 8:
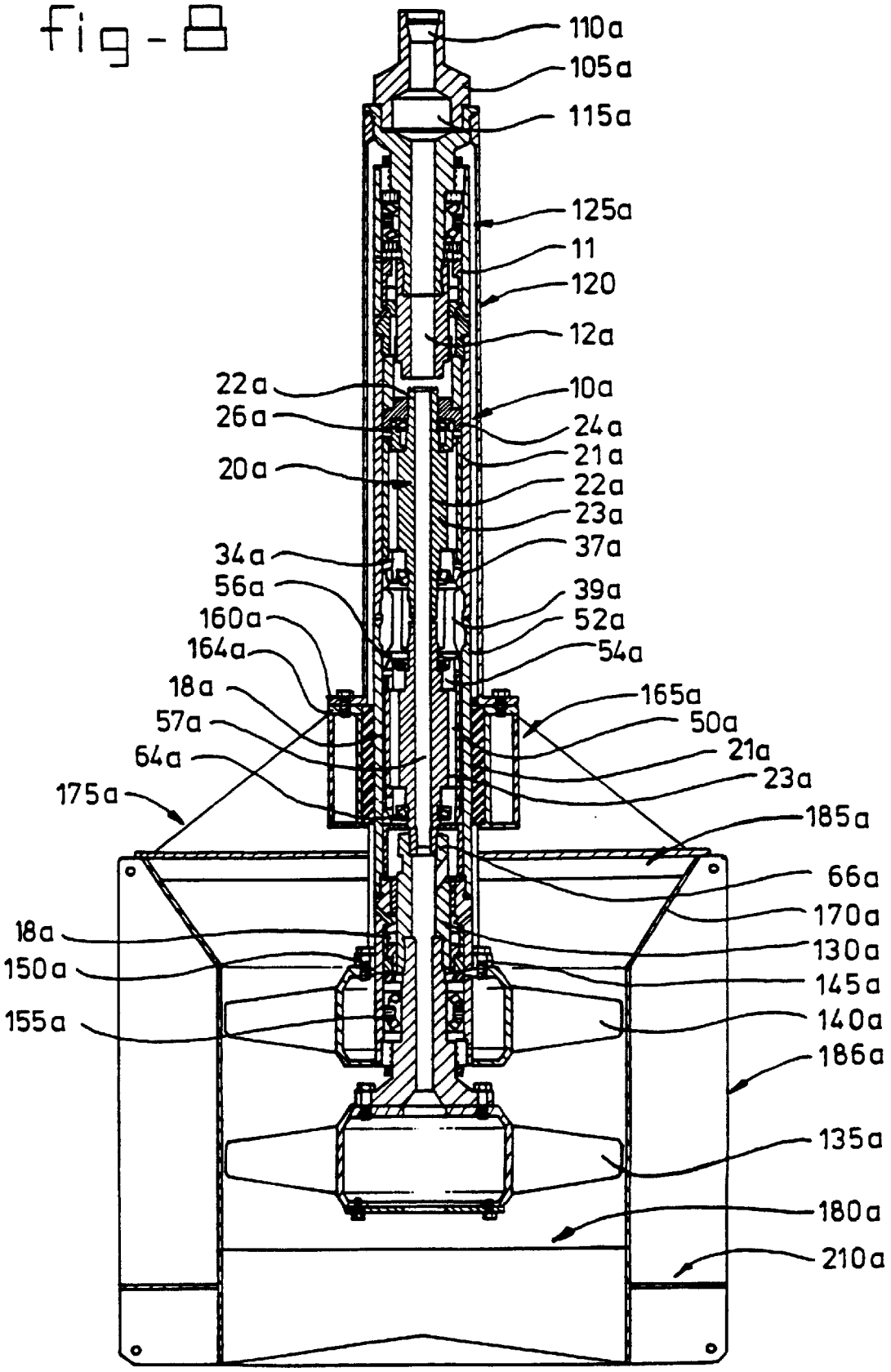
FIG. 8 shows a longitudinal cross-sectional view of a second embodiment of an underwater excavation apparatus according to the present invention.

Referring to FIG. 8 there is shown a second embodiment of an underwater excavation apparatus according to the present invention. Parts of this second embodiment are identified by the same integers as the parts of the first embodiment, but suffixed with an "a".

Figure 9:
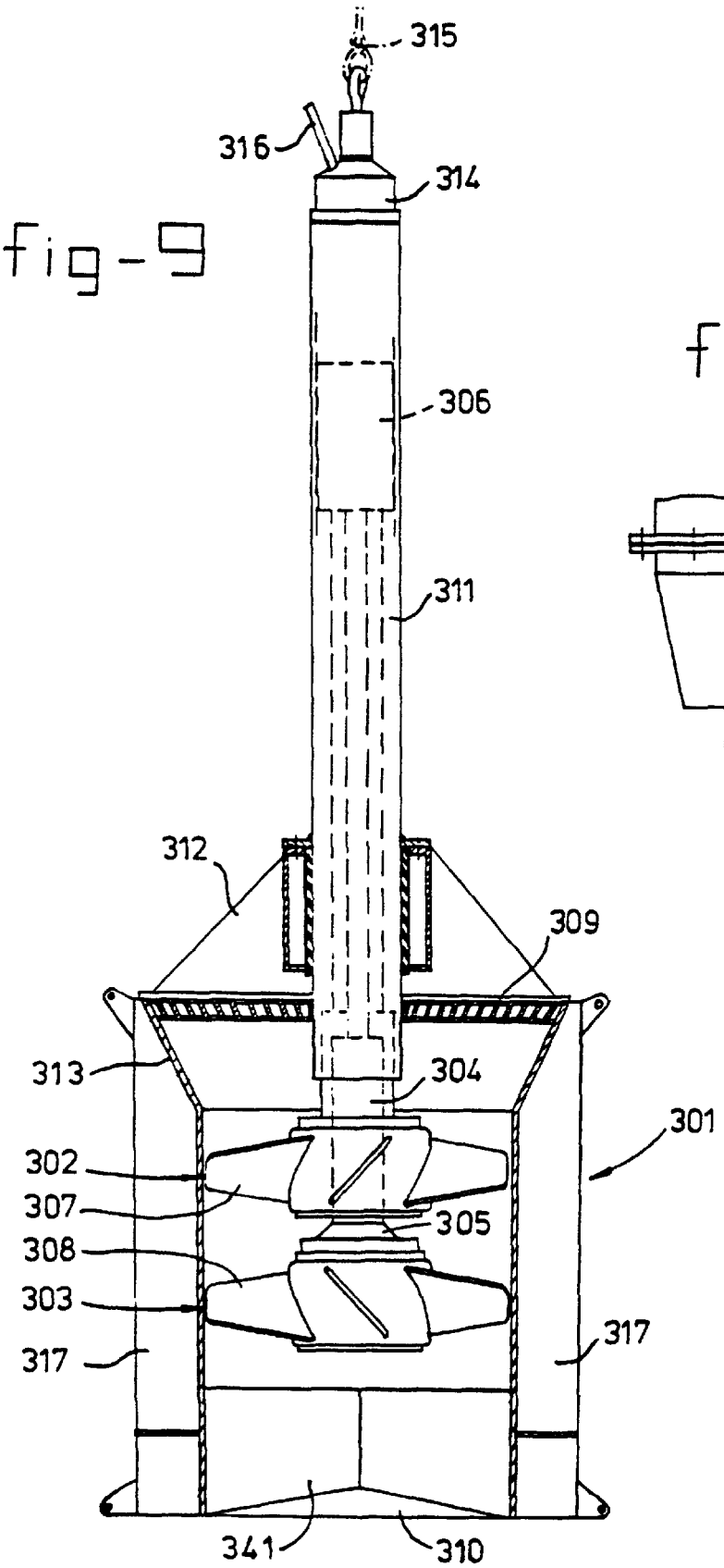
FIG. 9 shows a third embodiment of the apparatus according to the invention, partially in longitudinal section.
Figure 10:
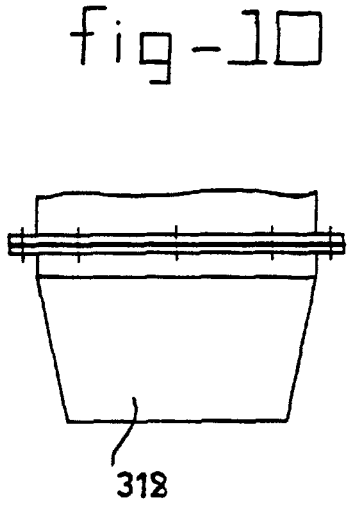
FIG. 10 shows an outflow nozzle for the apparatus.

The apparatus shown in FIG. 9 comprises a jet pipe which is shown in its entirety by 301, and in which the first screw 302 and the second screw 303 are rotatably accommodated. The first screw 302 is mounted on the hollow shaft 304, while the second screw 303 is mounted on shaft 305, which runs coaxially through the hollow shaft 304. Both shafts 304 and 305 are drivable by means of drive unit 306, which can also contain a reversing device, in such a way that the shafts 304 and 305, and thus the screws 302 and 303, are drivable in opposite directions of rotation. Since the pitch angle of the screw blades 307 of the first screw 302 is opposite to the pitch angle of the screw blades 308 of the second screw 303, the two screws 302, 303 here create a downward directed flow, running by way of the access grille 309 through the jet pipe 301 and out of the nozzle 310. An outflow nozzle 318 is shown in FIG. 10.

Flanges 312 can also act as flow guide baffles. Flow guide baffles 341 can be accommodated in the nozzle 310. It is also possible to fit flow guide baffles between screw 302 and 303, in order to reduce undesirable turbulence.

Both shafts 304, 305 are accommodated in a casing 311, from which the encasement 313 of the jet pipe 301 is suspended by means of flanges 312. At its top end the casing 311 is connected by means of a rotary bearing to head 314, to which a hoisting cable 315 can be fixed, and from which head 314 one or more electrical and/or hydraulic lines 316 for the 35 drive unit 306 are also guided.

The encasement 313 of the jet pipe 301 is provided on the outside with radial ribs 317, which give the encasement 313 the necessary rigidity.

The alternative nozzle 318 shown in FIG. 10 is designed so that it tapers downwards. When such a tapering nozzle 318 is used, a higher flow rate of the flow coming out of the jet pipe 301 can be obtained.

Since the first screw 302 rotates in the opposite direction to that of the second screw 303, and the screws 302 and 303 are further identical, with the exception of the pitch angle of their screw blades 307, 308, the resulting torque in operation about the longitudinal axis of the device is equal to zero. Very stable functioning of the device can be obtained in this way, without additional measures being necessary for stabilization.

Figure 11:
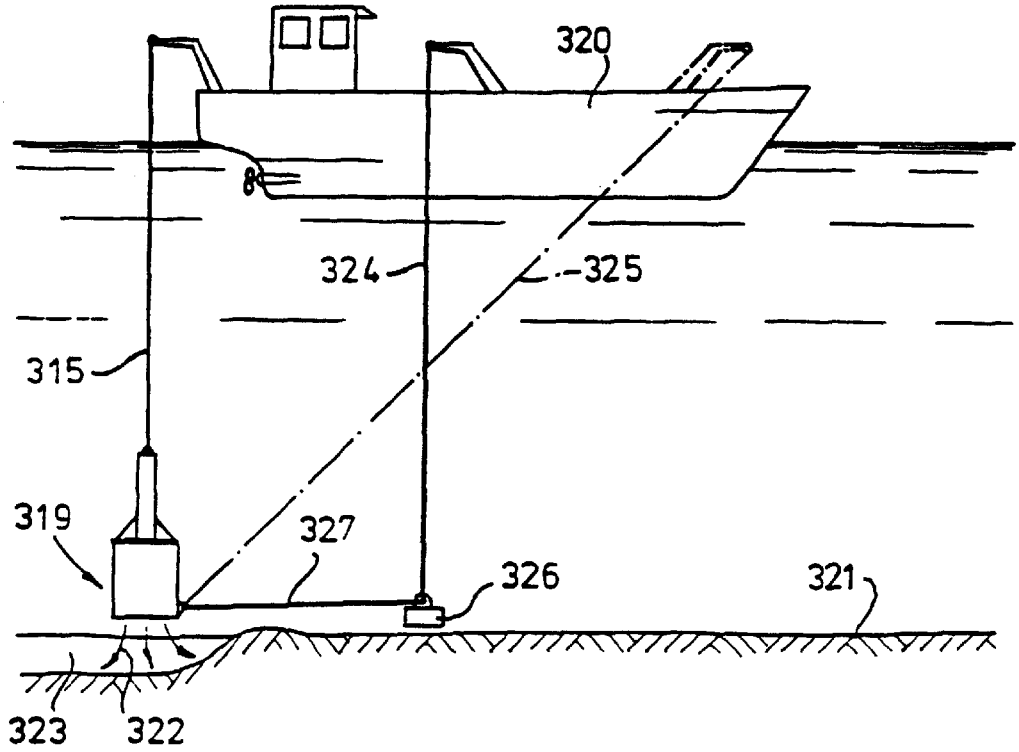
FIG. 11 shows a first possible application of the apparatus.

FIG. 11 shows a first potential application of the apparatus according to the invention. The apparatus, indicated in its entirety by 319, is supported by means of cable 315 relative to the vessel 320. The distance from the bed 321 of the body of water in which the vessel 320 is situated in this case is selected in such a way that the water flows 322 coming out of the apparatus according to the invention can form a trench 323 in said water bed 321.

In order to keep the apparatus 319 in place during the forward movement of the vessel 320, a stabilizing cable 324 is provided, which cable 324 has at its bottom end a ballast weight 326. Said ballast weight 326 is moved along with the apparatus in a fixed position relative to the vessel 320 and the water bed, connecting cable 327 between the ballast weight 326 and the apparatus according to the invention ensuring a corresponding position of said apparatus.

Instead of the cables 324 and 327 and ballast weight 326, it is also possible to ensure correct positioning of the apparatus by means of a stabilizing cable 325.

In normal circumstances the vessel will make a movement relative to the water bed 321 which coincides with its course. This course changes, however, when there are transverse flows in the body of water. In that case it can happen that the apparatus 319 takes a path over the water bed 321 which forms an angle with the course of the vessel 320. The desired course of the trench 323 in the water bed 321 can be achieved by adjusting the course of the vessel 320, i.e. directed at an angle to any transverse flow.

Figure 12:
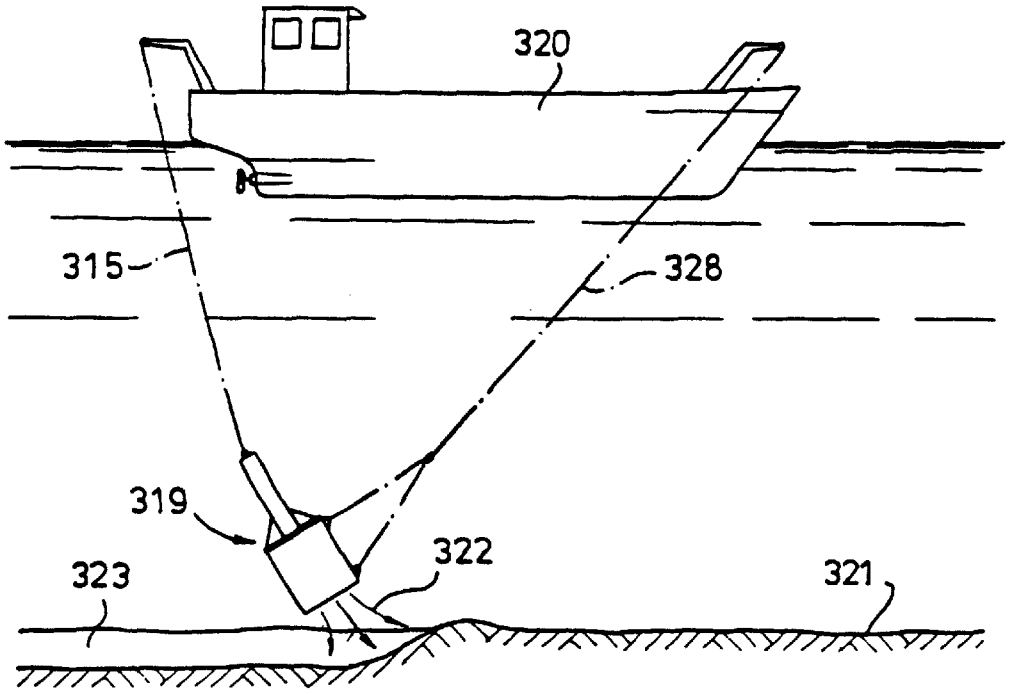
FIG. 12 shows a second possible application of the apparatus.

In the embodiment in FIG. 12 the apparatus 319 according to the invention is connected to the vessel 320 by means of a single stabilizing cable 328 and the hoisting cable 315. The apparatus 319 in this case is slanted slightly forward and downward, in such a way that the jet 322 is directed not only downward, but also forward. This means that the material flushed away is displaced better in a desired direction.

It is also possible to suspend the device at an angle in another direction by fixing the cables 315 and 328 in a different place on the vessel 320, for example at both sides.

Another variant is that one of the cables 315 or 328 is fixed on another vessel.

Figure 13:
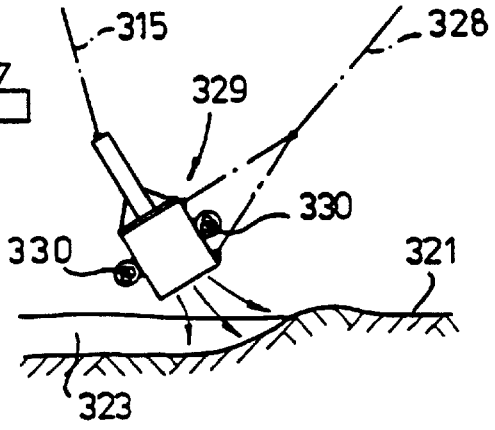
FIG. 13 shows an alternative embodiment of FIG. 12.

FIG. 13 shows the situation according to FIG. 12, but in this case the device 329 is provided with controllable, transversely directed drive screws, which position the device 329 better.

Instead of drive screws, water jets could also be used, possibly disposed in jet pipes.

Figure 14:
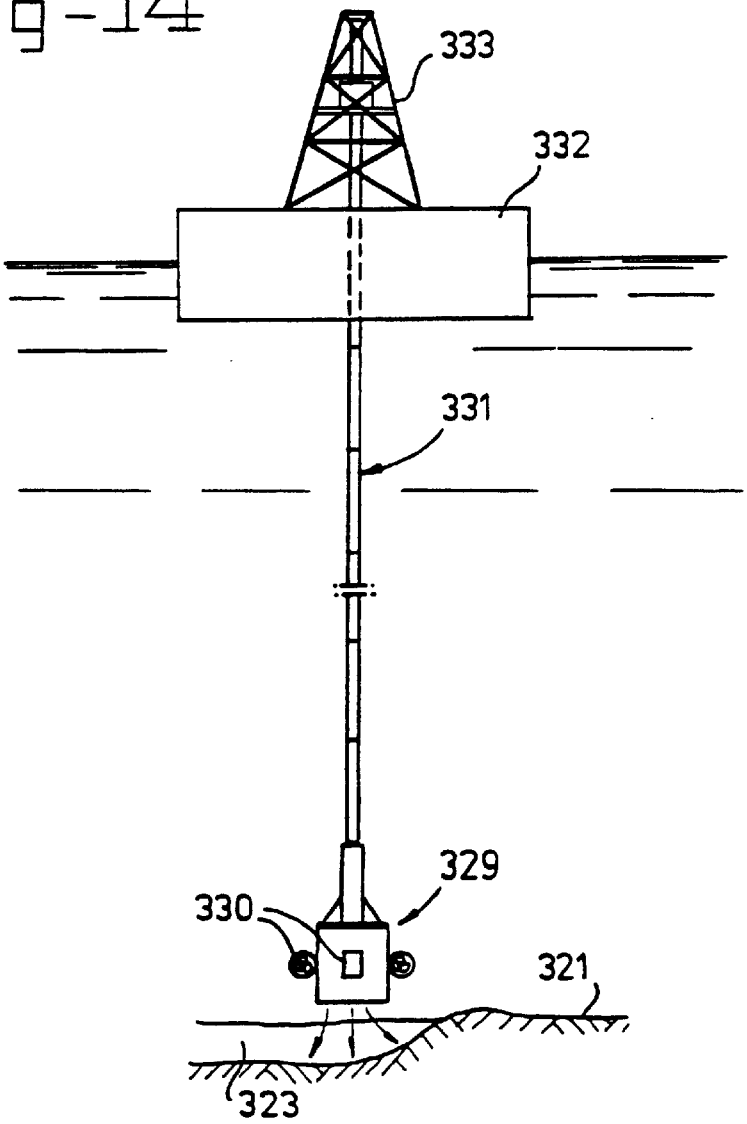
FIG. 14 shows a further possible embodiment of the apparatus.

In the possible embodiment of FIG. 14 the apparatus 329 according to the invention is suspended from a floating vessel or platform 332 by means of a string of metal pipes 331. As is customary in the case of drilling installations, the string 331 is suspended in a tower 333, which is equipped for assembling and taking in the string 331. Such an apparatus is very suitable for greater water depths, of several hundred metres.

Figure 15:
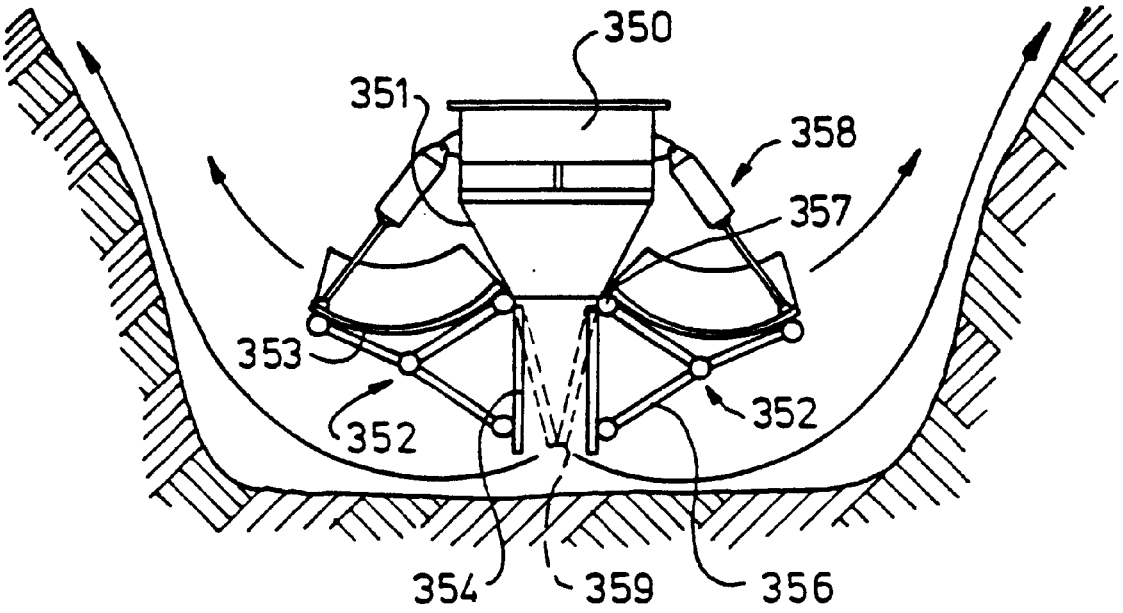
FIG. 15 shows a first alternative outflow nozzle.

FIG. 15 shows an alternative outflow nozzle, comprising a pipe section 350 to be mounted on the apparatus. The pipe section 350 is connected to a support structure consisting of beams 351. At the lower end of said support structure, two regulating devices 352 are situated. Each regulating device 352 comprises an arc shaped deflection plate 353 as well as a flat closure plate 354. Plates 353, 354 of each device 352 are mutually connected by means of hinged structures 356, so as to move as a unity each around hinge 357.

Plates 353 are partly situated in the outflow path from pipe section 350, whereby the flow is partly deflected sidewardly and downwardly or upwardly (depending on the position of plates 353), as indicated by the arrows. Thus, the bottom material can be removed in a more efficient way from a trench Cylinder-piston devices 358 are provided for setting the position of regulating devices 352.

As indicated by dotted lines 359, the regulating devices 352 can be placed in such position that plates 354 are closed, whereby the full flow is directed sidewardly.

Figure 16:
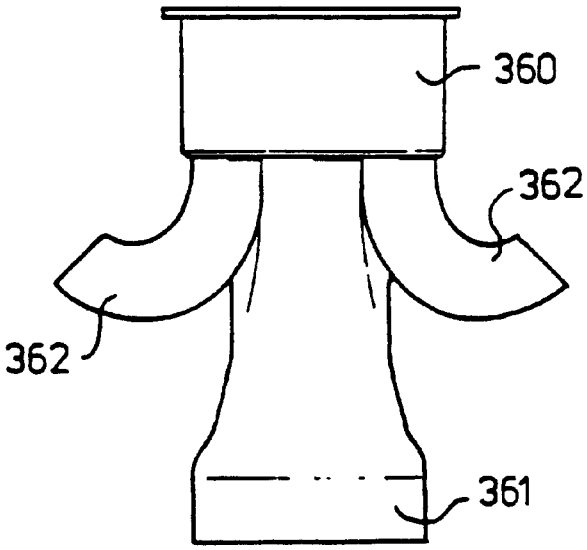
FIG. 16 shows a second alternative outflow nozzle.

FIG. 16 shows an outflow nozzle comprising a pipe section 360, which opens out via a single downwardly directed pipe 361, and two opposing, bent pipes 362 which are directed sidewardly and downwardly or upwardly.

This outflow nozzle offers an outflow in downward as well as in sideward and downward or upward direction.

We claim:

1. Underwater excavating apparatus (319, 329) for creating a local water flow or water jet in a body of water, in such a way that bed material from the bed (321) below said body of water can be displaced, which device comprises a jet pipe (301), a first screw (302) disposed rotatably in the jet pipe, a cable, and a second screw (303) accommodated in the same jet pipe (301) and arranged coaxially with respect to the first screw (302), wherein the second screw is rotatable in a direction opposite a direction of rotation of the first screw (302), the opposing rotational direction, pitch, and speed of rotation of the second screw being such that an amount of torque generated by the second screw is virtually the same as that of the first screw (302).

2. Device according to claim 1, in which an angle of the pitch of the second screw is opposite to a pitch angle of the first screw.

3. Device according to claim 1, in which one of the first and second screws (302) is connected to a hollow driving shaft (304), and another of the first and second screws (303) is connected to a central driving shaft (305) running coaxially through the hollow driving shaft (304).

4. Device according to claim 3, in which both drive shafts (304, 305) project from the jet pipe (301) at an inlet end thereof, and each of the drive shafts is connected to a drive unit (306).

5. Device according to claim 1, in which an outlet end (318) of the jet pipe (301) is tapered.

6. Device according to claim 1, in which the jet pipe (301) is provided with transversely directed, controllable water displacement means (330).

7. Device according to claim 1, in which the jet pipe (301) is adapted so that the axis of the screws can be disposed at an angle to the vertical.

8. Device as claimed in claim 1, further comprising a means for driving the screws which includes a drilling motor.

9. Device as claimed in claim 8, wherein the drilling motor is one of a hydraulic and an electric motor.

10. Device as claimed in claim 9, wherein the drilling motor comprises a stator and a rotor rotatably mounted in the stator, the stator being provided with a rod recess and an exhaust port, the rotor being provided with a rotor channel and at least one channel for conducting motive fluid from the rotor channel to a chamber between the rotor and the stator, the rod recess being provided with a rod which, in use, forms a seal between the stator and the rotor.

11. Device as claimed in claim 10, wherein the rotor is provided with a seal for engagement with the stator.

12. Device as claimed in claim 11, wherein the seal for engagement with the stator is made from a material selected from the group consisting of plastics materials, polyethylethylketone, metal, copper alloys and stainless steel.

13. Device as claimed in claim 10, wherein the rod is made from a material selected from the group consisting of plastics materials, polyethylethylketone, metal, copper alloys and stainless steel.

14. Device as claimed in claim 10, wherein the stator is provided with two rod recesses which are disposed opposite one another, and two exhaust ports which are disposed opposite one another, each of the rod recesses being provided with a respective rod, the rotor having two seals which are disposed opposite one another.

15. Device as claimed in claim 8, wherein two drilling motors are provided arranged with their respective rotors connected together each motor comprising a stator and a rotor rotatably mounted in the stator, the stator being provided with a rod recess and an exhaust port, the rotor being provided with a rotor channel and at least one channel for conducting motive fluid from the rotor channel to a chamber between the rotor and the stator, the rod recess being provided with a rod which, in use, forms a seal between the stator and the rotor.

16. Device as claimed in claim 15, wherein the drilling motors are connected in parallel.

17. Device as claimed in claim 15, wherein the drilling motors are connected in series.

18. Device as claimed in 15, wherein the drilling motors are arranged so that, in use, one drilling motor operates out of phase with the other.

19. Device as claimed in claim 18, wherein each drilling motor has two chambers and the chambers in the first drilling motor are 90° out of phase with the chambers in the second drilling motor.

20. Device as claimed in claim 18, wherein each drilling motor has four chambers and the chambers in the first drilling motor are 45° out of phase with the chambers in the second drilling motor.

21. Device apparatus as claimed claim 1, comprising means for steering the device, in use.

22. Device as claimed in claim 21, wherein the steering means comprises at least four apertures on the device, the apertures being equally spaced around a plane through the device, which plane is intended to be substantially horizontal in use, openable gates on each of the four apertures, and means for controlling the opening and closing of each gate.

23. Device as claimed in claim 22, wherein each gate provides a portion which extends inwardly when the gate is open, the portion further closing the aperture when the gate is closed.

24. Device as claimed in claim 22, wherein the control means comprises an actuator for each gate, each actuator being controlled by means of a conduit extending above surface.

25. Device as claimed in claim 21, wherein the steering means comprises one or more openable flaps located on the outlet.

26. Device as claimed in claim 1, wherein each screw includes a plurality of blades, the blades of one screw being offset by 180° with respect to the blades of the other screw of the pair.

27. Device as claimed in any preceding claim, wherein the screws are in the form of propellers.

28. Device as claimed in claim 27, wherein the screws are in the form of propellers provided with water jets on tips thereof.

29. Device according to claim 1, further comprising an outlet end having diverter means for directing the flow at least partly sidewardly.

30. Device according to claim 29, in which the diverter means are selectively controllable.

31. Device according to claim 1, further comprising an outlet end having diverter means for directing the flow at least partly upwardly.

* * * * *